US007524144B2

(12) United States Patent
Gravier et al.

(10) Patent No.: US 7,524,144 B2
(45) Date of Patent: Apr. 28, 2009

(54) RETAINING WALL

(75) Inventors: Robert Allan Gravier, Edina, MN (US); Timothy Allen Bott, Sunfish Lake, MN (US)

(73) Assignee: Allan Block Corporation, Edina, MN (US)

( * ) Notice: Subject to any disclaimer, the term of this patent is extended or adjusted under 35 U.S.C. 154(b) by 993 days.

(21) Appl. No.: 10/873,904

(22) Filed: Jun. 22, 2004

(65) Prior Publication Data

US 2005/0279046 A1 Dec. 22, 2005

(51) Int. Cl.
*E02D 29/02* (2006.01)

(52) U.S. Cl. ..... 405/262; 405/284; 405/286

(58) Field of Classification Search ..... 405/262, 405/284, 286; D25/118
See application file for complete search history.

(56) References Cited

U.S. PATENT DOCUMENTS

| | | | | |
|---|---|---|---|---|
| 2,668,435 | A | | 2/1954 | Clements |
| 3,925,994 | A | | 12/1975 | Broms et al. |
| 4,068,482 | A | | 1/1978 | Hilfiker |
| 4,324,508 | A | | 4/1982 | Hilfiker et al. |
| 4,379,659 | A | | 4/1983 | Steiner |
| 4,470,728 | A | | 9/1984 | Broadbent |
| 4,592,678 | A | | 6/1986 | McNinch, Jr. et al. |
| 4,616,959 | A | | 10/1986 | Hilfiker |
| 4,662,794 | A | | 5/1987 | Delmas et al. |
| 4,671,706 | A | | 6/1987 | Giardini |
| 4,802,320 | A | | 2/1989 | Forsberg |
| 4,824,293 | A | | 4/1989 | Brown et al. |
| 4,884,921 | A | | 12/1989 | Smith |
| 4,920,712 | A | | 5/1990 | Dean, Jr. |
| 4,964,761 | A | | 10/1990 | Rossi |
| 5,007,218 | A | | 4/1991 | Bengston et al. |
| 5,028,172 | A | | 7/1991 | Wilson et al. |
| 5,066,169 | A | | 11/1991 | Gavin et al. |
| 5,072,566 | A | | 12/1991 | Zeidman |
| 5,108,231 | A | | 4/1992 | Rausch |
| 5,177,925 | A | | 1/1993 | Winkler et al. |
| 5,214,898 | A | | 6/1993 | Beretta |
| 5,257,880 | A | * | 11/1993 | Janopaul, Jr. ..... 405/284 |
| 5,355,647 | A | | 10/1994 | Johnson et al. |
| D353,680 | S | | 12/1994 | Jansson |
| D357,748 | S | | 4/1995 | Jansson |
| 5,419,092 | A | | 5/1995 | Jaecklin |

(Continued)

FOREIGN PATENT DOCUMENTS

| | | |
|---|---|---|
| AU | 636100 B3 | 4/1993 |

(Continued)

*Primary Examiner*—Frederick L Lagman
(74) *Attorney, Agent, or Firm*—Fredrikson & Byron, P.A.

(57) ABSTRACT

A concrete block structure useful in forming a retaining wall having upwardly open openings to facilitate planting plants therein. The block has an upright front wall, laterally spaced side walls joined to the front wall, and an upwardly open interior, the side walls having upwardly open and laterally aligned grooves formed in them, and a rod received within the grooves and protruding laterally beyond each side wall. A flexible anchor sheet having a forward edge portion may extend along and above at least two adjacent blocks of the course, the anchor sheet being attached to the rod and extending rearwardly over an upper surface of the rear wall for anchoring reception in an embankment against which the blocks are placed.

19 Claims, 4 Drawing Sheets

U.S. PATENT DOCUMENTS

| | | | | |
|---|---|---|---|---|
| 5,484,236 | A | 1/1996 | Gravier | |
| 5,564,865 | A | 10/1996 | Jansson | |
| 5,595,460 | A * | 1/1997 | Miller et al. | 405/284 |
| 6,287,054 | B1 * | 9/2001 | Egan et al. | 405/262 |
| 6,761,509 | B2 * | 7/2004 | Jansson | 405/286 |
| D514,232 | S * | 1/2006 | Jansson | D25/118 |
| D528,223 | S * | 9/2006 | Jansson | D25/118 |
| 2003/0213203 | A1 * | 11/2003 | Bott et al. | 405/262 |
| 2004/0018061 | A1 * | 1/2004 | Jansson | 405/284 |

FOREIGN PATENT DOCUMENTS

| | | |
|---|---|---|
| DE | 25 37 408 | 4/1976 |
| FR | 2 687 707 | 8/1993 |

* cited by examiner

RETAINING WALL

FIELD OF THE INVENTION

The invention involves concrete blocks that may be stacked and assembled to form a plantable retaining wall for retaining earthen embankments.

BACKGROUND OF THE INVENTION

Retaining walls are used to stabilize and retain in position earthen embankments, such as those bordering highways. Such walls have been made of concrete blocks having various configurations, the blocks generally being stacked one atop another against an earthen embankment with the wall formed by the blocks being canted back into the earthen wall. The blocks may be formed so that upwardly open spaces are formed in the wall in which bushes or other vegetation can be planted. In addition, individual blocks of such walls may have anchors that extend rearwardly into the earthen embankment to more securely support the blocks. Anchors of this type are known in the art, and reference is made to Jansson, U.S. Pat. No. 5,564,865 as showing blocks and walls made from such blocks.

It is generally desired that retaining walls of the type described exhibit certain favorable characteristics, among which may be mentioned the ease with which the retaining wall can be assembled, the stability of the wall (that is, its ability to maintain structural integrity for long periods of time), and the ability of the wall to admit and disburse rainwater.

Although retaining wall blocks commonly are supported vertically by resting upon each other, it is important that the blocks be restrained from moving outwardly from the earthen wall that they support. By utilizing anchor configurations that support only individual blocks in a course of blocks, the alignment between adjacent blocks in a course or between different courses may be difficult to achieve and perhaps more difficult to maintain through years of use.

SUMMARY OF THE INVENTION

We have found generally that a retaining wall, which has plantable openings, can be formed from blocks having aligned grooves in their side walls with a laterally oriented rod received in the grooves and extending laterally between a plurality of blocks in a horizontal course. A sheet of anchor material, such as material known as "geogrid", may be attached to the rod, with the anchor material extending rearwardly for anchoring in an earthen embankment, the elongated rod and the anchoring material contributing to the ease with which courses of blocks may be in placed, and contributing also to the strength of the anchoring system in which tensile forces on the anchoring material may be spread among a plurality of blocks in the course.

In one embodiment, a concrete block structure is provided, which comprises, in combination, a concrete block useful in forming a retaining wall having upward openings to facilitate planting plants therein, the block having a front wall, spaced side walls and an open interior. The side walls have upwardly open and aligned grooves formed in them. A rod that extends between adjacent blocks in a course is received in the aligned side wall grooves, the rod protruding laterally beyond each side wall and serving to align the blocks. A flexible anchoring sheet is provided, the sheet having a front portion that is attached to the rod. The sheet extends rearwardly over and in contact with the upper surface of the rear wall.

In certain embodiments, a plantable retaining wall is provided that comprises a plurality of concrete blocks positioned side by side in a first course. Each block has an upright front wall, and side walls with upwardly facing surfaces, the blocks having an upwardly open interior. The front wall extends upwardly beyond the side walls, and the side walls are laterally spaced and have upwardly open, laterally extending grooves formed in them with the grooves of one block being generally laterally aligned with the grooves of one or more adjacent blocks in the same course. A rod extends along the course and is received in the grooves, the rod being of sufficient length to extend across the width of at least two adjacent blocks. A flexible anchoring sheet extends along the course of blocks. The anchoring sheet has a front portion attached to the rod, the sheet extending rearwardly over the upper surfaces of the rear wall for reception in an embankment against which the blocks are placed.

DESCRIPTION OF PREFERRED EMBODIMENTS

Figure 1:
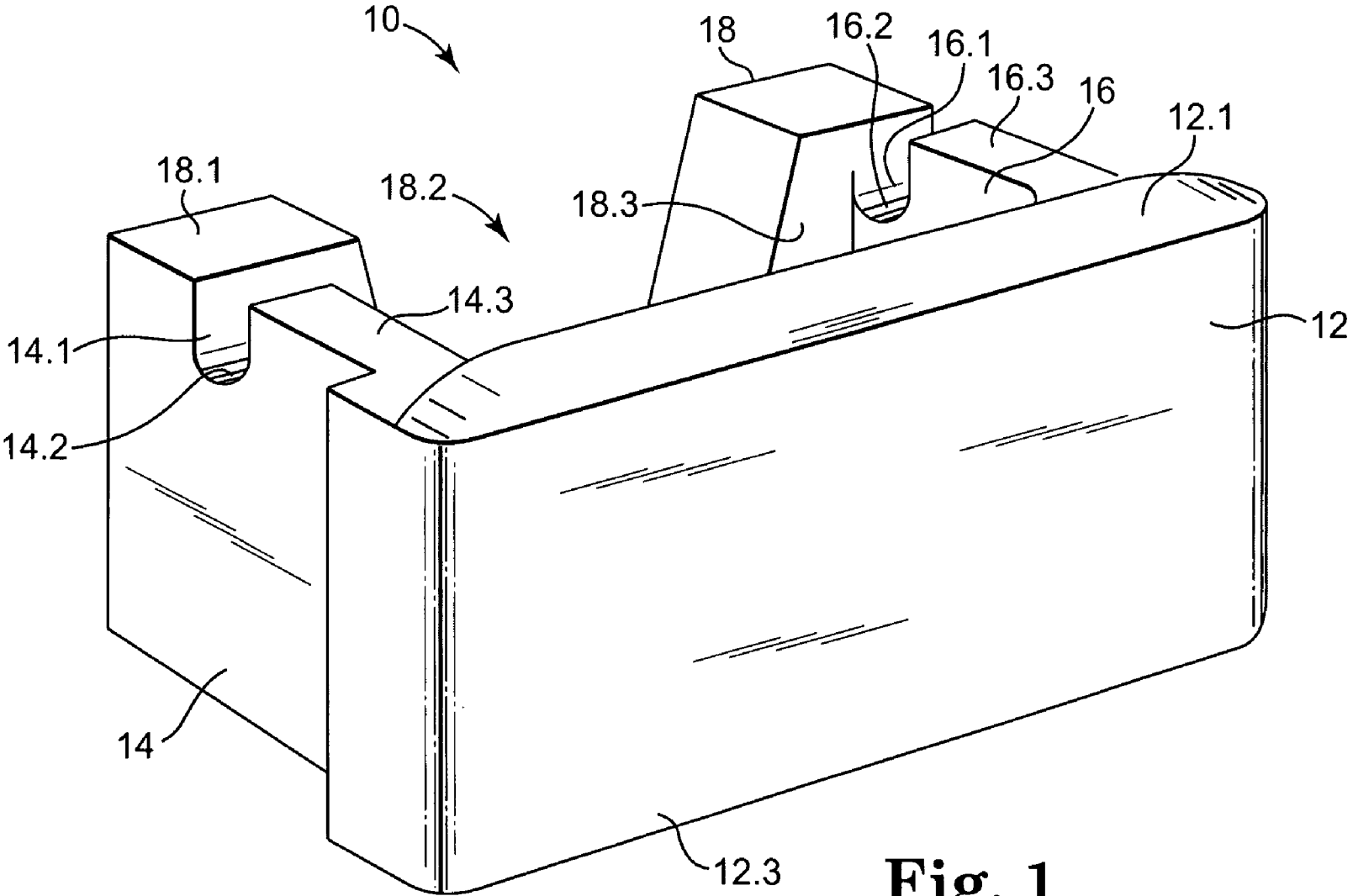
FIG. 1 is a perspective view of a plantable block.
Figure 2:
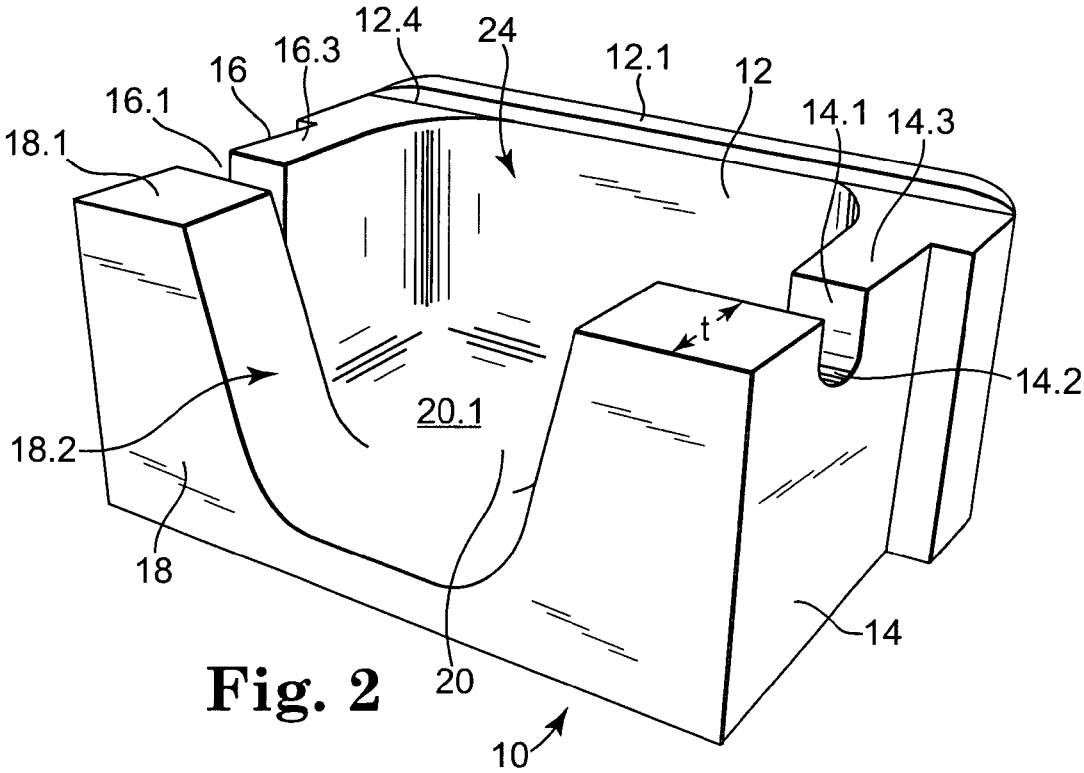
FIG. 2 is a perspective view of the block of FIG. 1, taken from another angle.

FIGS. 1 and 2 show a plantable block 10 suitable for use in forming a plantable retaining wall, the block having an upright front wall 12, laterally spaced side walls 14, 16, a rear wall 18, and a bottom wall 20. The front wall has an upwardly extending lip 12.1 that extends upon the elevation of the side and rear walls. The bottom surface 22 of the blocks (FIG. 3) may be planar, and the bottom wall may have an aperture formed in it (not shown) to aid in drainage. As shown best in FIG. 2, the block 10 has an upwardly open interior 24, and the intersections of the interior walls are rounded to avoid stress concentrations and to aid in the ease of manufacturing the block through the pouring of concrete into a mold.

The rear wall 18 desirably has a thickness "t" (FIG. 2) that is greater than the thickness of the side walls 14,16 for reasons that will become evident from the description that follows. The upper surface 18.1 of the rear wall 18 has a generally centrally positioned opening 18.2 formed in it, the opening extending downwardly at least to the level of the upper surface 20.1 of the bottom wall 20, so that when the block is employed in a retaining wall, water within the interior 24 of the block may drain rearwardly out of the block. If desired, the upper surface 20.1 of the bottom wall may be slanted downward and rearward to aid in drainage.

Figure 3:
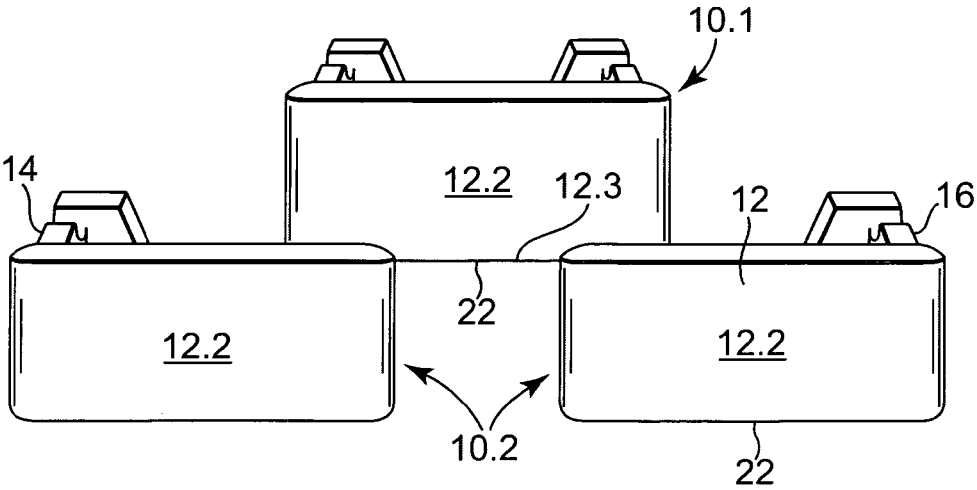
FIG. 3 is a schematic view showing three blocks arranged in two courses.

As shown best in FIGS. 1 and 2, the side walls 14, 16 have grooves 14.1, 16.1 formed in them, the grooves extending downward from their upper surfaces and extending through the thicknesses of the side walls. The grooves are aligned with each other, and are spaced, desirably, at equal distances from the front wall 12. In the embodiment of FIGS. 1, 2 and 3, the grooves are formed such that the rear portion of each groove coincides with the forwardly facing wall 18.3 of the rear wall 18, but if desired, the grooves 14.1, 16.1 may be moved forwardly slightly to provide a short length of side wall between the grooves and the forwardly facing surface of the rear wall. As explained in greater detail below, the grooves are configured to receive within them a rod. As depicted, the grooves have a rounded bottom 14.2, 16.2 so as to closely receive a rod that has a generally circular cross section. The rod may have any appropriate cross section, such as a square cross section, and the bottom surface 14.2, 16.2 of the grooves may be similarly shaped if desired.

Upper surfaces 14.3, 16.3 of the side walls are generally substantially co-planar with the upper surfaces 18.1 of the rear walls, although the upper surfaces of the rear walls may be depressed slightly to accommodate a flexible anchor sheet, as described below. FIG. 3 depicts schematically how two adjacent courses of blocks may rest one upon the other. In FIG. 3, the bottom surface 22 of the upper block 10.1 rests upon the upper surfaces 14.3, 16.3 of the side walls and the upper surface 18.1 of the rear wall of the blocks 10.2 in the lower course. The front surface 12.2 of the upper block 10.1 is positioned slightly to the rear of the front surfaces 12.2 of the lower course of blocks 10.2, so that the bottom front edge 12.3 of the top block is received in the intersection 12.4 between the lip 12.1 and the side walls 14, 16, as shown in FIG. 2. The slope of the resulting wall may thus be controlled by the front-to-rear thickness of the lip 12.1.

The blocks of the invention can be made through a process similar to that taught in Gravier, U.S. Pat. No. 5,484,236, the disclosure of which is incorporated herein by reference. An upwardly open mold box having walls defining the exterior surfaces of the front, side and rear walls of a block is positioned on a conveyor belt, the rear wall portion including an insert matching the rear opening 18.2 of the block. A removable top mold portion is configured to match the surfaces forming the upwardly open interior 24 of the block and also the inner portion of the upper lip 12.1. A zero slump concrete slurry is poured into the mold and the top mold portion is inserted, care being taken to distribute the slurry throughout the interior of the mold, following which the top mold portion is removed, as are the front, rear and side walls of the mold box, and the block is allowed to fully cure.

Figure 4:
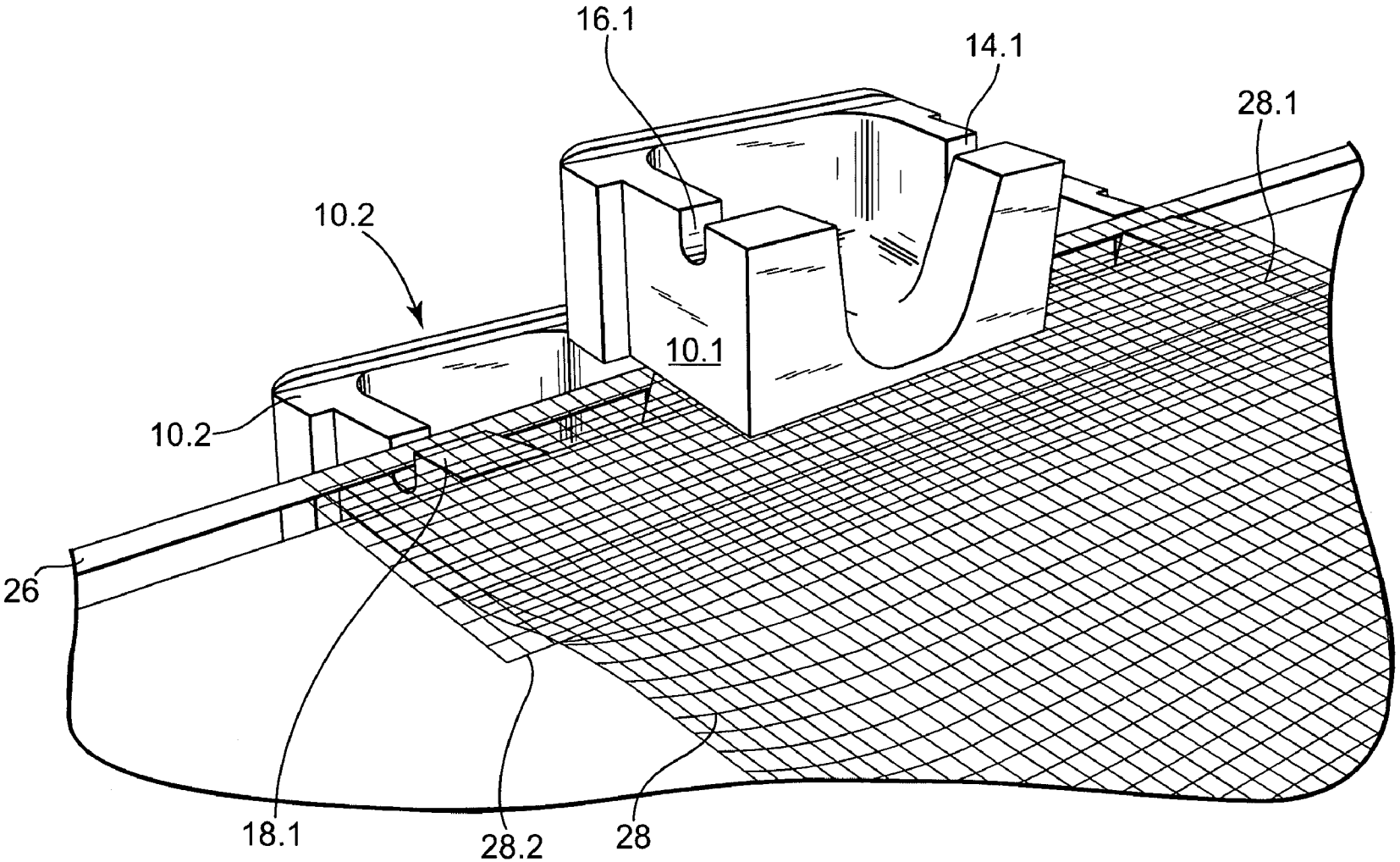
FIG. 4 is a perspective view similar to FIG. 3 but showing placement of a rod and flexible anchor sheet.

Referring now to FIG. 4, which is similar to FIG. 3 but which shows added features, an elongated rod 26 is received within the grooves 14.1, 16.1 of at least two adjacent blocks 10.2 of a lower course of blocks. The rod itself may be circular in cross section, or may have various other cross sections as desired, and the rod desirably is hollow, that is, tubular. It is contemplated that the rod, in the form of tubing having small perforations through its wall, may be employed to deliver water to plants growing in the upwardly open spaces of the wall. Note should be made that the rod 26 extends laterally through the grooves of at least two adjacent blocks 10.2 in the lower course, the rod in this manner, serving to maintain lateral alignment and also forward/rearward alignment between adjacent blocks in the course. The rod 26 itself may be made out of a flexible material such as polyvinyl chloride tubing or the like, the rod desirably having sufficient flexibility to enable the blocks in a course to laterally conform smoothly to a curved embankment. That is, the rod may be sufficiently rigid to maintain alignment between adjacent blocks in a course, but may bend on a large radius to enable the blocks in the course to conform smoothly to the contour of an embankment.

As shown in FIG. 4, an anchor sheet 28 is provided. The lateral width of the anchor sheet is greater than the width of two adjacent blocks. The forward end portion 28.1 of the sheet is attached to the rod 26, and may, as shown in FIG. 4, be wrapped around the rod with the end 28.2 of the sheet being brought back rearwardly for a distance of a foot or so. In this manner, the sheet (and in this example, two thicknesses of the sheet), pass over the upper surfaces 18.1 of the rear wall of the lower course 10.2 of blocks. The bottom surface of the upper course of blocks 10.1 bears downwardly upon the upper side wall surfaces 14.3, 16.3 of the bottom blocks, and presses downwardly upon the anchor sheet as the anchor sheet passes over the upper surfaces 18.1 of the rear wall, pinching the anchor sheet between these surfaces. In this manner, the rod 26 is locked in its position within the grooves by the bottom surface of the upper course of blocks, and the anchor sheet is firmly attached to the rod. The resulting connection between the anchor sheet and the blocks is such that when a rearward tensile force is applied to the anchor sheet during a testing operation, neither the concrete block structure nor the attachment of the anchor sheet to the rod fails before the anchor sheet itself begins to yield. As mentioned above, the rear wall has a thickness "t" that is greater than the thickness of the side walls, the thick rear wall providing a wide surface across which the rod ands wrapped anchor sheet may bear rearwardly, and also adding strength to the block so that the rear wall of the block is not broken off rearwardly in response to a high rearward-directed tensile force on the anchor sheet.

The anchor sheet can be any of several materials that are resistant to degradation in moist soils. The sheet desirably is perforated so as to enable rainwater to flow downwardly through the openings in the sheet and not become trapped by the sheet. Materials known as geogrid materials can be appropriately used, these materials being formed, for example, of high density polyethylene or high tenacity polyester. They may be in the form of net-shaped synthetic polymer-coated fibers. Geogrid sheets are available commercially; one such material being sold under the trademark FORTRAC, by Huesker Inc.

Figure 5:
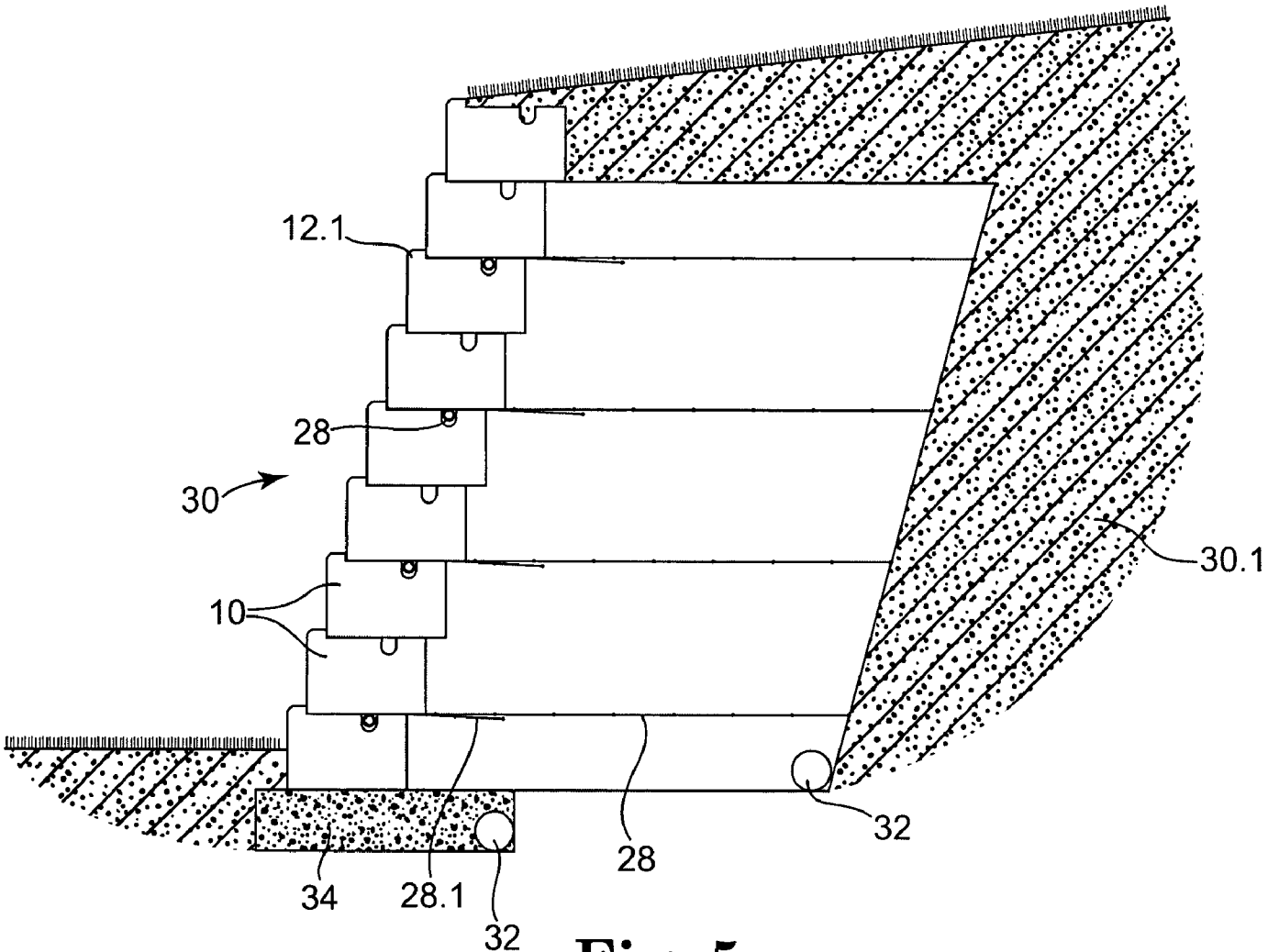
FIG. 5 is a diagrammatic view showing a retaining wall in place against an earthen embankment.

A retaining wall 30 is shown schematically in FIG. 5, and comprises blocks 10 that are supported upon one another in the manner described above in connection with FIGS. 3 and 4. In the drawing, every second course of blocks is provided with a rod 26 and an anchoring sheet 28. If desired, each course of blocks may be provided with a rod and anchoring sheet, or every third or fourth course may be so provided, depending on such factors as the geometry of the system and the type and nature of the local soils. A soil embankment is shown at 30.1, and in FIG. 5, a portion of the backfilled soil has been left clear of cross hatching to show structure and position of the anchoring sheets. Perforated drain tiles 32 may be positioned as shown and are vented to the exterior of the embankment. Desirably, drain rock 34 is positioned beneath the first course of blocks. As exemplified in FIG. 5, a base comprising a six inch deep layer of drain rock is provided that is level and compacted in a twelve inch deep trench so that the top of the drain rock is below grade.

The embankment 30.1 is first excavated, and the retaining wall is constructed course by course, with back fill of earth occurring periodically and at least after each course of blocks carrying a rod and anchor sheet are laid. As will be evident, the anchoring sheets 28 are placed for the purpose of restraining the blocks 10 from moving forward, away from the embankment. The use of anchor sheets, and the formation, course by course, of retaining walls of this type are known, and need not be described further. As desired, if the rod 28 is a perforated plastic pipe, such as polyvinyl chloride, the pipe may be connected to a source of water so that plants in the wall may be periodically watered.

The use of an elongated rod that extends through grooves in a plurality of blocks in a course contributes to the ease with which the blocks may be placed and positioned, the rod serving to maintain lateral alignment between adjacent blocks in a course, and flexibility of the rod contributing to the formation of a smooth curve to match the planned smooth curve of the embankment. The anchor sheet, which extends laterally along a plurality of blocks, tends to distribute any tensile loads experienced by the sheet and thus reduces the likelihood that the sheet will rupture under localized high tensile loads.

While preferred embodiments of the present invention have been described, those skilled in the art will recognize that further modifications may be made without departing from the intent of the invention. All such modifications are intended to be claimed as that fall within the scope of the invention.

The invention claimed is:

1. A concrete block structure useful in forming a retaining wall having upwardly open openings to facilitate planting plants therein, the block having an upright front wall, laterally spaced side walls joined to the front wall with a rounded intersection on an interior side of the front wall and side walls, a rear wall having a thickness greater than a thickness of the side walls and joined to the side walls, and an upwardly open interior, the side walls having upwardly open and laterally aligned grooves formed in them such that a rear portion of each groove coincides with a forwardly facing wall of the rear wall, and a rod received within the grooves and protruding laterally beyond each side wall.

2. The concrete block of claim 1 including a bottom wall, the rear wall having an opening formed therein, the opening being positioned to drain water rearwardly from within said block.

3. The concrete block of claim 2 wherein said rear wall has an upper surface, said bottom wall has an upper surface, and wherein the opening in the rear wall extends downwardly from the rear wall upper surface to the upper surface of the bottom wall.

4. The concrete block of claim 3 wherein said grooves are spaced forwardly of said rear wall.

5. The concrete block of claim 1 wherein said grooves have a depth below the upper surface of the rear wall that is slightly greater than the heigth of the rod.

6. The concrete block of claim 5 including a flexible anchor sheet attached to the rod and extending rearwardly over and in contact with the upper surface of the rear wall.

7. A concrete block structure useful in forming a retaining wall having upwardly open openings to facilitate planting plants therein, the block having an upright front wall, laterally spaced side walls joined to the front wall with a rounded intersection on an interior side of the front wall and side walls, a rear wall having a thickness greater than a thickness of the side wall, joined to the side walls, and defining an upper surface, and an upwardly open interior, the side walls having upwardly open and laterally aligned grooves formed in them to a predetermined depth below the upper surface of the rear wall and formed such that a rear portion of each groove coincides with a forwardly facing wall of the rear wall, a rod having a height approximating said predetermined depth and received within the grooves, the rod protruding laterally outward beyond each groove, and a flexible anchor sheet having a front portion attached to the rod, the sheet extending rearwardly over and in contact with the upper surface of the rear wall.

8. The concrete block structure of claim 7 wherein said sheet is wrapped about the rod and is secured between the rod and the laterally spaced grooves.

9. The concrete block structure of claim 7 wherein a side wall of said block has a bottom surface confronting and contactable with the side wall upper surface of an identical block in a next lower course, whereby said sheet is captured between and supported by the confronting surfaces.

10. The retaining wall of claim 9 wherein at least some of said blocks in the first course have a bottom wall, the rear wall having an opening formed therein, the opening being positioned to drain water rearwardly from within said blocks.

11. The retaining wall of claim 10 wherein wherein the opening in the rear wall extends downwardly from the rear wall upper surface to the level of the bottom wall.

12. A concrete block useful in forming a retaining wall having upwardly open openings to facilitate planting plants therein, the block having an upright front wall, laterally spaced side walls joined to the front wall with a rounded intersection on an interior side of the front wall and side walls, a bottom wall with an upper surface, and a rear wall joined to the side walls and defining an upper surface, the side walls having upwardly open and laterally aligned grooves formed in them such that a rear portion of each groove coincides with a forwardly facing wall of the rear wall, the rear wall having an upper surface and having a thickness greater than the thickness of either side wall, the rear wall having an upwardly open opening extending downwardly from its upper surface to the level of the upper surface of the bottom wall to facilitate drainage from the block.

13. The retaining wall of claim 12, wherein an upper surface of the bottom wall is slanted downward and rearward to aid in drainage from the block.

14. The retaining wall of claim 12, wherein a rear surface of the rear wall forms a generally planar surface at the rearmost portion of the concrete block.

15. A plantable retaining wall comprising a plurality of concrete blocks positioned side-by-side in a first course, each block having an upright front wall, and laterally spaced side walls joined to the front wall with a rounded intersection on an interior side of the front wall and side walls, and a rear wall having a thickness greater than a thickness of the side walls and joined to the side walls, the rear wall having an upper surface, each block having an upwardly open interior, the front wall extending upwardly beyond the side walls, the side walls having upwardly open, laterally aligned grooves formed through them such that a rear portion of each groove coincides with a forwardly facing wall of the rear wall, the grooves of one block being generally laterally aligned with the grooves of one or more adjacent blocks in the course, a rod extending along said course and received in the laterally aligned grooves of at least two adjacent blocks in said course, and a flexible anchor sheet having a forward edge portion extending along and above at least two adjacent blocks of said course, said sheet being attached to the rod and extending rearwardly over the upper surface of the rear wall for anchoring reception in an embankment against which the blocks are placed.

16. The retaining wall of claim 15 wherein the forward edge portion of the sheet is wrapped about the rod with the wrapped rod received in the upwardly open grooves.

17. The retaining wall of claim 15 wherein the retaining wall includes a plurality of blocks forming a second course and having bottom surfaces confronting and resting on the first course of blocks and upon said sheet with the sheet captured between said confronting surfaces.

18. The retaining wall of claim 15 wherein the forward edge portion of the sheet is wrapped about the rod and the wrapped rod is received in the upwardly open grooves, the retaining wall including a plurality of blocks forming an upper course and having bottom surfaces resting on the first course of blocks and upon said sheet.

19. The retaining wall of claim 15 wherein said rear wall has a thickness greater than any other wall of the block.

* * * * *